US006705051B1

(12) United States Patent
Wall

(10) Patent No.: US 6,705,051 B1
(45) Date of Patent: Mar. 16, 2004

(54) METHOD OF TRANSPORTING PREFABRICATED MODULE WITH ROOF MOUNTED IN A HORIZONTAL POSITION AND APPARATUS FOR MOUNTING THE ROOF DURING TRANSPORT

(76) Inventor: Harlin J. Wall, 974 Greenbriar Dr., State College, PA (US) 16801

( * ) Notice: Subject to any disclaimer, the term of this patent is extended or adjusted under 35 U.S.C. 154(b) by 28 days.

(21) Appl. No.: 09/920,820

(22) Filed: Aug. 3, 2001

Related U.S. Application Data

(60) Provisional application No. 60/272,306, filed on Mar. 2, 2001.

(51) Int. Cl.[7] ..... E04B 7/16

(52) U.S. Cl. ..... 52/66; 52/71; 52/79.5; 52/93.2; 52/640; 52/646; 403/121

(58) Field of Search ..... 52/66, 70, 71, 52/79.5, 90.1, 91.1, 91.3, 92.2, 93.1, 93.2, 640, 645, 646; 403/83, 84, 121

(56) References Cited

U.S. PATENT DOCUMENTS

| | | | | | |
|---|---|---|---|---|---|
| 2,051,707 | A | * | 8/1936 | Harrison | 52/64 |
| 2,820,995 | A | | 1/1958 | Schlueter | |
| 3,296,752 | A | | 1/1967 | Philp | |
| 3,302,341 | A | | 2/1967 | Konopasek | |
| 3,312,018 | A | | 4/1967 | Fourmanoit | |
| 3,485,346 | A | | 12/1969 | Ballard | |
| 3,699,731 | A | | 10/1972 | Arnold | |
| 3,736,708 | A | | 6/1973 | Chapman | |
| 3,760,550 | A | | 9/1973 | Mueller et al. | |
| 3,890,747 | A | * | 6/1975 | Van Der Lely | 52/64 |
| 4,035,096 | A | | 7/1977 | Miller | |
| 4,045,926 | A | | 9/1977 | Gibbs | |
| 4,118,901 | A | * | 10/1978 | Johnson | 52/18 |
| 4,167,090 | A | | 9/1979 | Sanford | |
| 4,170,852 | A | | 10/1979 | Danis, Jr. | |
| 4,283,889 | A | | 8/1981 | Dunn | |
| 4,327,532 | A | * | 5/1982 | Matthews | 52/92 |
| 4,467,572 | A | | 8/1984 | Somers et al. | |
| 4,467,585 | A | | 8/1984 | Busby | |
| 4,479,333 | A | | 10/1984 | Hendrich | |
| 4,724,646 | A | | 2/1988 | Meyers | |
| 4,928,444 | A | | 5/1990 | Horie et al. | |
| 5,085,622 | A | | 2/1992 | Kohlpaintner et al. | |
| 5,144,776 | A | * | 9/1992 | Hetzel et al. | 52/92 |
| 5,556,221 | A | | 9/1996 | Brunner | |
| 5,778,604 | A | * | 7/1998 | Snow | 52/66 |
| 5,921,033 | A | * | 7/1999 | Molina | 52/67 |
| 6,085,469 | A | * | 7/2000 | Wolfe | 52/71 |

* cited by examiner

*Primary Examiner*—Carl D. Friedman
*Assistant Examiner*—Naoko Slack
(74) *Attorney, Agent, or Firm*—Wenderoth, Lind & Ponack, L.L.P.

(57) ABSTRACT

A method of transporting a module of a modular structure to a building site on a transporter with a roof of the module in a horizontal position, and an apparatus for coupling the roof to the base structure of the module to permit movement of the roof between the horizontal position and a final sloped position. The coupling apparatus includes a coupling assembly adapted to be detachably coupled in a C-shaped rafter or guide rail of the roof so as to guide movement of the rafter or guide rail relative to the coupling mechanism, and an anchor assembly pivotally coupled to the coupling assembly so as to permit pivotal and vertical movement of the coupling assembly. Each of the anchor assemblies is adapted to be secured to an attic floor panel of the module.

13 Claims, 4 Drawing Sheets

METHOD OF TRANSPORTING PREFABRICATED MODULE WITH ROOF MOUNTED IN A HORIZONTAL POSITION AND APPARATUS FOR MOUNTING THE ROOF DURING TRANSPORT

This application claims the benefit of U.S. Provisional Application No. 60/272,306, filed Mar. 2, 2001.

BACKGROUND OF THE INVENTION

1. Field of the Invention

The present invention relates to a novel method of transporting a prefabricated building module from a plant to a building site, and an apparatus for mounting a roof of the module to permit movement of the roof between a horizontal position during transport and,a raised position at the building site.

2. Description of Related Art

The construction of modular building structures, which are fabricated at a housing plant, is limited by applicable laws and regulations. The United States housing industry, which includes HUD-code homes and modular housing, is controlled by laws that limit the dimensions of products that can be shipped over the interstate highways. These limitations include width restrictions to insure vehicular safety, height restrictions to clear overhead obstructions, and length restrictions of the modular unit and transporter.

Typically manufactured HUD homes and modular homes include three dimensional "boxes or modules" that are shipped over the road, and thus are confronted with the continuing problem of the regulatory shipping limitations. Accordingly, the most economical roof designs have generally-been limited to low and medium pitched roofs. Also, the height limitations impose constraints on the design of the building structures, and the building structures have taken on the connotations associated with the homes produced by the earlier mobile home industry. Various solutions have been proposed, such as entirely independent roof sections and saddle roofs that hang over the side of the module. However, shipping independent roof sections substantially increases the construction and transportation costs, and saddle roof designs consume a portion of the over-the-road regulatory width, thereby reducing the allocable width of the module living space. Both of these methods have limitations and increase the cost of equivalent floor area in the building structures.

Furthermore, the applicable laws have created several limitations within the modular housing industry such as:

1. The dimensional geometry of the shipped product is restricted to widths of 12 feet, 14 feet, and 16 feet (under controlled conditions); heights of 14 feet, which includes either the transporter or wheel and rail assemblies; and lengths of 80 feet.

2. The traffic flow patterns within the housing plans are restricted, which causes stairways to the second floor of 12 foot and 14 foot wide modules to be L-shaped with landings and returns. This is necessary to fit the stair within the restricted-module widths, which must ultimately terminate near the center of the second floor traffic pattern.

3. The lengths of the modules are required to be extended, in the only dimension available, in order to overcome the limitations o f the width of the module. This is necessary to encapsulate more floor area. Also, as the lengths of the modules have been extended upward in excess of 70 feet, the modules have been exposed Ito increased flexure during shipping and handling, resulting in increased damage to both the structure and interior finishes of the module.

4. The extended module lengths have created awkward planning constraints that require the main front entrances of the homes to be located near the center of the modules in order to minimize the length of hallways and to improve efficient access to rooms at the ends of the modules.

5. The extended module lengths have necessitated that the slope direction of the major roof be 90 degrees with respect to the length of the module in order to remain below the shipping height limitations. By employing multiple roof panels, which are folded during shipping and unfolded and tilted up during the erection process, the housing industry has successfully created techniques that achieve up to 12/12 roof pitches. However, this requires the production of additional multiple panels and substantially increases costs. Furthermore, this process exposes the module to potential weather damage during the erection procedure.

6. The total width of one and two story homes is limited to two modules having a combined width of approximately 28 feet. This is necessary in order to avoid the creation of saw-tooth roof configurations, which are created by joining more than two modules. Saw-tooth roof configurations are inconsistent with the aesthetics of traditional home designs. Furthermore, limiting the house width to two module widths, avoids the complicated water drainage problems created by the long valleys of saw-tooth roofs. Some patio homes have been produced in contemporary plans by sliding and offsetting the modules in a direction parallel to their longitudinal dimension, thereby reducing the problems associated with the saw-tooth roofs. However, this has been accomplished by increasing the exterior wall area, which inherently increases the heating and cooling costs.

The above-discussed limitations have affected not only the housing product itself, but have also imposed restrictions on the siting of the homes on the lots. The positioning of the front entrances near the center of the modules, as previously explained, has in most designs, required that the lengthened modules be sited parallel to the front lot line. This is necessary to avoid the alternative positioning at 90 degrees to the front lot line, which would place the front entrance adjacent to the side lot line and thereby provide inadequate visibility from the street. Further, the lengthened modules require wider lots, which inherently increases the infrastructure cost of the lots. Also, the present lengthened modules are not compatible with the concept of clustered housing on smaller lots, which is being promoted today in order to reduce housing costs. The clustered housing concept requires housing products that can more effectively utilize the depth of the lots without placing the front entrances adjacent to the side lot lines.

The HUD-code home and modular housing industries of today have evolved from a combination of the mobile home industry of the 1950's and on-site construction. Planning, with the assistance of computers, has enabled module producers to offer a range of customization within the above-described constraints. Although the production of the modular homes occurs in the controlled environment of a plant, the homes are still constructed with conventional materials, in much the same way as in the mobile home industry of the 1950's and the frame construction of site-built homes.

The evolution of the modular production process has occurred without recognizing and utilizing the accomplishments and techniques of the automotive industry. A new approach could find new techniques, solve the problems created by the limitations discussed above, and enhance all aspects of the housing products while reducing costs.

By recognizing and utilizing advances in the automotive industry, the scale of the planning component in the housing industry can be increased from the historic 2×4 wood stud to a functional module. Accordingly, an object of the present invention is to provide a completely new approach to the structure for roofing modules that will overcome most of the previously discussed limitations.

SUMMARY OF THE INVENTION

In order to meet future needs, the present invention provides an industrialized housing system, a system of standardized spatial modules of varying functional and utilitarian use, and modules that can be selected and composed by the consumer so as to create unlimited house designs. This will meet the consumer's spatial, cost, and aesthetic needs. Also, coupling option and finish packages for selection by the consumer, will add to the customization.

The present invention is effective to increase the scale of the manufactured component to that of functional modules that can be arranged in the field to permit unlimited single and multi-family housing designs and provide the consumer with unlimited house planning capabilities and greatly reduced housing costs.

More particularly, the present invention provides a novel roof coupling and guiding mechanism that employs a roller assembly or a sliding assembly, and is constructed so that it can be temporarily or permanently installed. The roof coupling and guiding mechanism permits the roof panels of three dimensional housing or commercial space modules to be shipped in a horizontal or flat position and parallel to the longitudinal dimension of the module. The coupling mechanism also permits the roof panels to be raised at the construction site to their final designed slope. The roof panels may be constructed of light gauge steel, wood framing, or structural insulated panels.

Further, the coupling mechanism of the present invention is effective to stabilize, anchor, and safely hold the temporarily stored flat roof panels on top of the modules during shipping.

Further, the coupling device is operable to guide, stabilize, and control the direction of movement of the roof panels during a crane lifting process at the construction site. In particular, the coupling device permits the roof panels to roll or slide toward a final designed ridge position above the three dimensional module so as to allow roof slopes of any desired pitch. With the coupling device, the crane can lift the roof panels, at their hinged juncture, to the final designed slope either before or after the three dimensional module is placed in its final position in the building structure.

The coupling device allows the roof panel to extend into the space provided by the more liberal shipping length dimension. The coupling device can be used to permit the creation of gable roofs, mansard roofs, hip roofs, and shed roofs in their final position atop the module.

A preferred embodiment of the coupling device has an anchor portion that telescopes vertically to allow the sandwiching of gable end wall panels, hip roof panels, and ancillary small gable and dormer panels so that these panels can be temporarily stored in a position beneath the major roof panels. The stored panels are hinged to the major roof panels to permit them to slide across the attic floor into their final position as the major roof panels are raised. The coupling device telescopes into itself as the major roof is raised into its final position on the three dimensional module.

Further, the device enables the ridge of a roof to be located at 90 degrees relative to the longitudinal dimension of the modules, thereby allowing a ridge at any position above the module and the possibility of varying the pitch on each side of the ridge.

The present invention provides modules that can be produced so as to remain within the restricted shipping widths and heights. The invention allows the utilization of the allowable shipping length to ship flat roof panels installed, atop the three dimensional modules parallel to the longitudinal dimension of the modules. This permits the installation of the major roof panels that slope in a direction that is 90 degrees relative to the industry standard.

The present invention, which permits installation of the major roof panels at 90 degrees relative to the industry standard, also permits house plans composed by assembling a series of modules at 90 degrees to the industry standard. This permits straight run stairways to be installed parallel the longitudinal dimension of the modules, with a more than adequate length dimension, and termination of the stairways near the center of the second floor traffic pattern.

The present invention also permits the assembly of a series of modules with parallel major roof slopes joined at their marriage walls thereby encapsulating large floor areas with reduced module lengths of approximately 50% of the industry standard. The shortened longitudinal dimensions of the modules provide more structural rigidity and less exposure to flexure during shipping, thereby reducing interior finish damage.

In the present invention, the major roof panels are installed at 90 degrees relative to the industry standard, housing plans can be assembled with a series of modules at 90 degrees relative to the industry standard. This permits recessed front entrances to be provided in the transverse dimension (the width) of any module from the front of the house. Further this orientation of the modules permits the inclusion of sundecks, front porches with roofs, solariums, bay windows, extended breakfast nooks from kitchens, and other architectural features to enhance the aesthetics of the home. This is accomplished in the transverse wall on either end of the module without protruding into the limiting transportation widths controlling the modular industry. With the dimensional depth of the house being able to increase beyond the normal maximum industry standard of 28 feet, it is possible to shorten hallways and place the rooms in closer proximity to the central circulation pattern.

As described above, the present invention permits the creation of roofs of any pitch by shipping in a flat position and rolling them up into their designed configuration upon arrival at the construction site. This can be accomplished with a minimum number of major roof panels and with minimal weather exposure during the erection process.

In accordance with the present invention, since the major roof panels are installed at 90 degrees relative to the industry standard, the housing plans can be composed by assembling a series of modules at 90 degrees relative to the industry standard. This permits the house plan to be composed of a number of modules of varying widths, connected about their marriage walls, with the roof slopes being parallel. Accordingly, a saw-tooth configuration is avoided.

The present invention allows the longitudinal dimensions of the modules to be installed parallel to the side lot lines, placing the transverse dimension with the front entrance parallel and facing the front lot line. The longitudinal dimension better utilizes the depth of the lot and allows the narrow width of the house to be placed on smaller and narrow clustered housing designed lots.

The present invention permits true industrialization and production of a system of standardized spatial modules of varying functional and utilitarian use. This is accomplished by overcoming and eliminating the roof constraints and limitations of the industry today. The present invention achieves this object by allowing the composition and assembly of varying module width with parallel roof planes to create an unlimited selection of functional and utilitarian use modules so that consumers can design their own home.

BRIEF DESCRIPTION OF THE DRAWINGS

The foregoing and other objects of the invention will become more clear from the following detailed description of a preferred embodiment of the invention taken in conjunction with the drawings wherein.

DETAILED DESCRIPTION OF THE INVENTION

Figure 1:
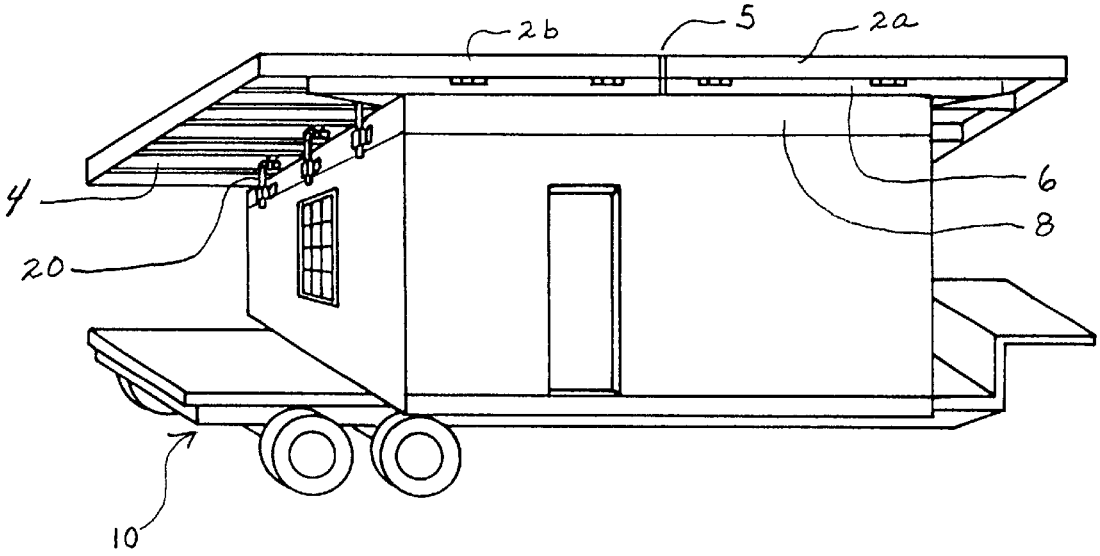
FIG. 1 is a perspective view of a housing module supported on a transporter with roof panels installed in a flat or horizontal position on the module.

In FIG. 1, an example of a prefabricated housing module 1 is shown positioned on a transporter 10. A roof 2 is mounted on the housing module 1 in a flat position. The roof 2, shown in FIG. 1, is constructed of two prefabricated major roof panels 2*a*, 2*b*, a plurality of:rafters 4, and gable panels 6. In the illustrated embodiment, the structural frame of each prefabricated roof panel includes six (6) C-shape light gage steel rafters, positioned 24" on center. The rafters 4 are sheathed on the top and open on the bottom. Note that the C-shape rafters can also be of a minimum short length required, and screw attached to a conventional wood structured roof panel to provide the same functions as provided by a light gage steel framed roof panel.

Figure 2:
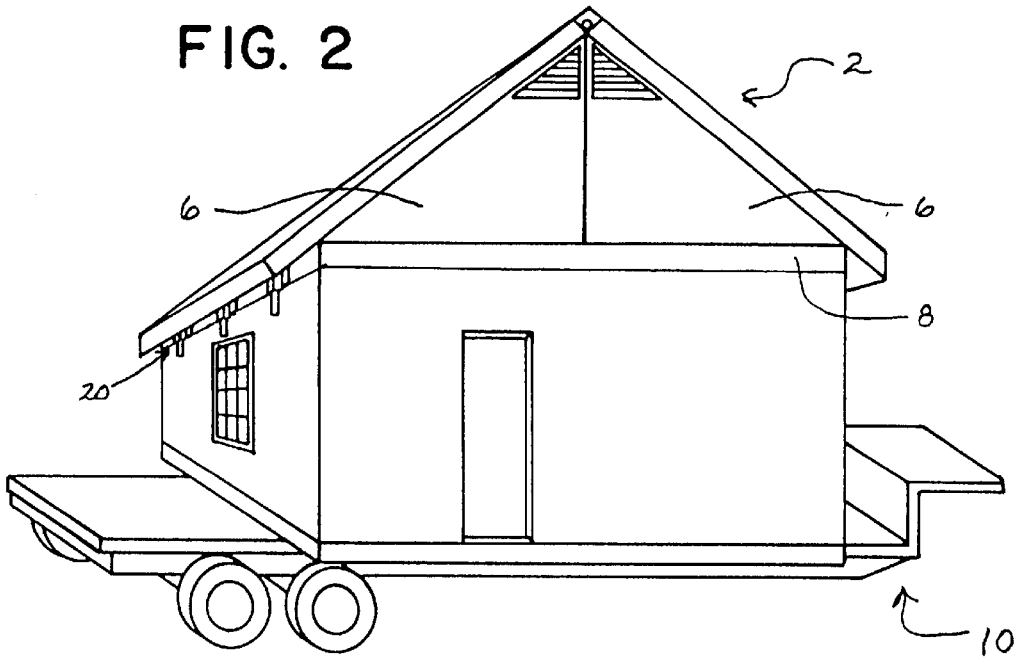
FIG. 2 is a perspective view of the housing module, shown in FIG. 1, with the roof panels raised to their final sloped position.

The gable panels 6 are pivotally connected to the roof panels 2*a*, 2*b* so as to be movable between a horizontal folded position, as shown in FIG. 1, and a vertical (final) position, as shown in FIG. 2.

As shown in FIGS. 1–2, the roof panels 2*a*, 2*b* are secured to an attic floor panel 8 of housing module 1 with a plurality of roof coupling and guide mechanisms 20. In the illustrated embodiment each roof panel is secured with three (3) roof coupling and guide mechanisms. However, the specific number can be adjusted in view of the particular application.

Figure 3:
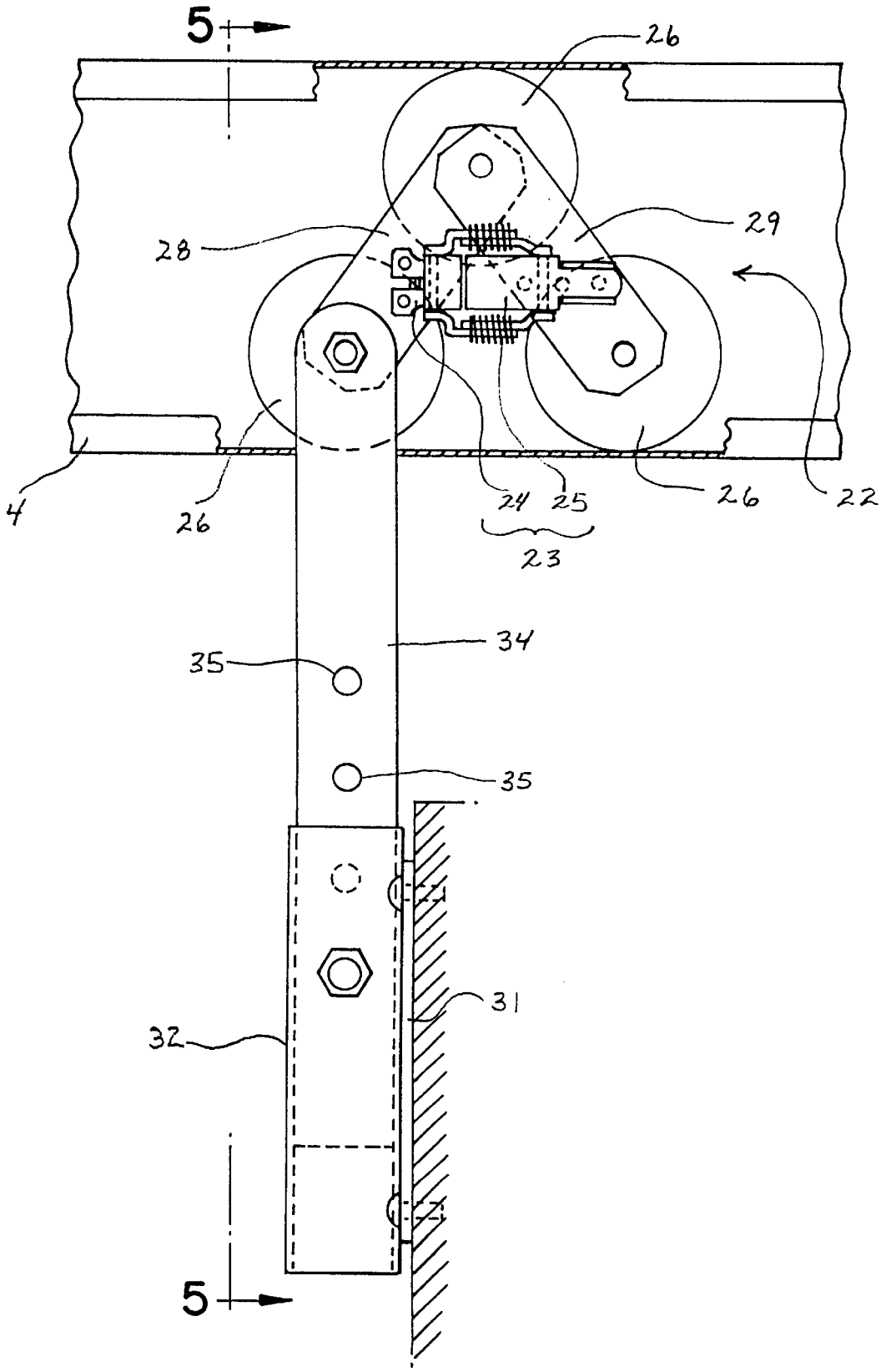
FIG. 3 is a side view of a roof roller guide positioned in a rafter when the roof panels are in the flat position.
Figure 4:
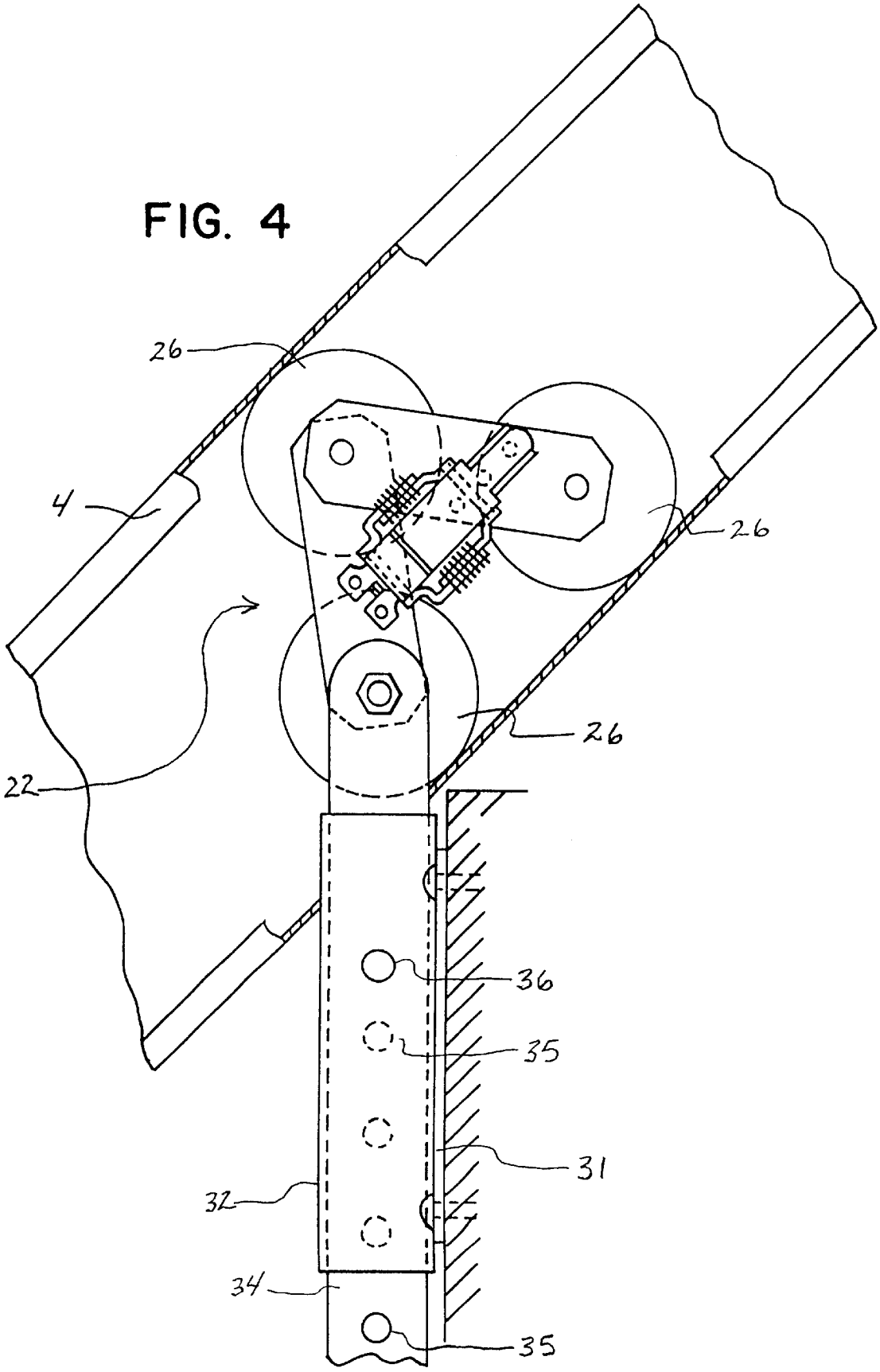
FIG. 4 is a side view of the position of the rafter and roof roller guide shown when the roof panels are in a raised position.
Figure 5:
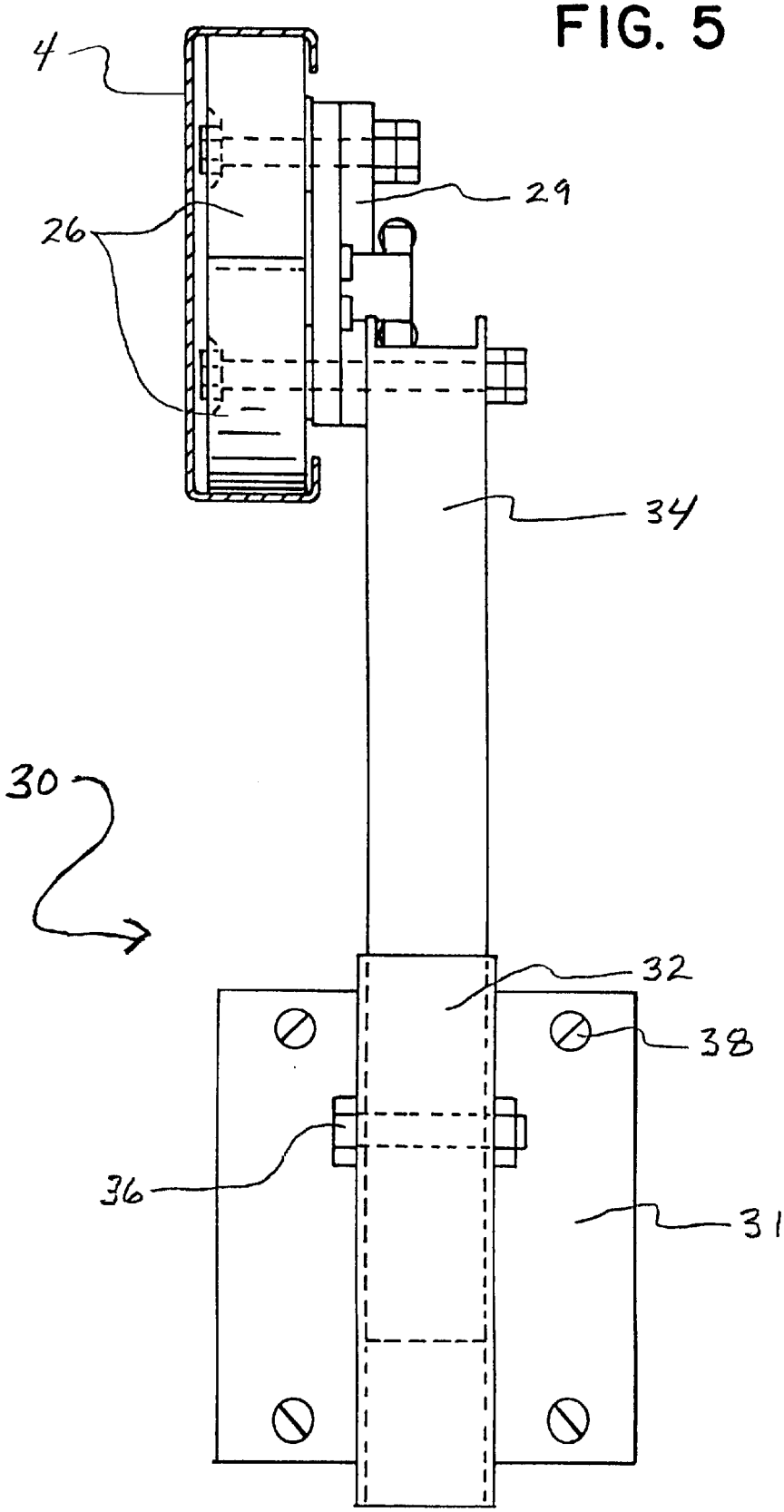
FIG. 5 is a front view of the roof roller guide shown in FIG. 3.

The details of the roof roller coupling and guide mechanism 20 are shown in FIGS. 3–5. Note, the roof coupling and guide mechanism 20 includes a roller assembly 22 and an anchor assembly 30. Each roller assembly 22 is received in one of the rafters 4 and is pivotally coupled to the anchor assembly 30, which is secured via screws 38 to the attic floor panel 8 of housing module 1. Note that the roller assembly 22 could also be received in a C-shaped guide rail that is secured to one of the roof panels.

In the illustrated embodiment, each roller assembly 22 includes three (3) wheels or rollers 26 interconnected by two (2) plates 28, 29, which are pivotally connected via an axle of the center roller. Since the plates 28, 29 are mounted oh the axle of the center roller, the three rollers 26 can be moved between a linear configuration (not shown) and a triangular configuration as shown in FIGS. 3–4. Further, the leftmost roller, as viewed in FIG. 3, is rotatably connected to an outer end of plate 28, and the rightmost roller is rotatably connected to an outer end of plate 29. As described above, the center roller is rotatably connected to the inner ends of the plates 28, 29.

The roof roller assembly 22 also includes a spring tension locking assembly 23 comprised of a catch 24 mounted on plate 28 and a strike 25 mounted on plate 29. A suitable locking device is manufactured by Piedmont Equipment Co. of Charlotte, N.C. and includes catch no. 595206491 (SC-D-20649 ZINC) and strike no. 595216501 (SC-D-20650 ZINC). However, any locking arrangement that is capable of releasably securing the rollers in the triangular engagement configuration can be employed.

The locking assembly 23 can be released to permit rollers to move toward the linear configuration so as to allow insertion of the roof roller assembly 22 into the C-shape of the rafter 4. After the roller assembly is inserted into the rafter 4, the spring tension assembly is retensioned to approximately 70 lbs, which is sufficient to securely lock the rollers in the triangular engagement configuration within the rafter 4. In this position the rafter 4 can slide relative to the roller assembly, and such sliding movement is guided by the rollers.

The anchor assembly 30 includes an anchor plate 31, an anchor tube 32 fixed to the anchor plate 31, and a vertical adjustment tube 34, which is slidably received in anchor tube 32 and pivotally connected to roller assembly 22. The anchor plate 31 is provided with a plurality of through holes for receiving screws 38 so that the anchor plate 31 can be secured to the attic floor panel 8 of housing module 1.

As can be seen in FIGS. 3–4, the vertical adjustment tube is formed with a plurality of through holes 35, and the anchor tube 32 has at least one through hole 36. Accordingly, the vertical position of the adjustment tube 34 can be fixed by aligning through hole 36 with one of through holes 35 and inserting a pin through the aligned holes.

As shown in FIGS. 1 and 3, the vertical adjustment tube 34 moves upward relative to the anchor tube 32, and is then pinned to the anchor tube 32 to allow the roof panels 2*a*, 2*b* to be positioned horizontally on top of the gable panels 6 in a transport position for shipment, from the plant. Also, the pin can be removed to permit the vertical adjustment tube 34 to slide down in anchor tube 32 as the roller assembly 22 guides the roof panel in controlled alignment as the roof panel pivots about the top edge of the module to eventually be secured in a final position (see FIGS. 2 and 4). The vertical adjustment allows various roof panel designs to assume this position, including hip panels and shed panels.

The number of roof roller guide mechanisms that are employed for each roof panel, will be depend on the size and weight of the roof panel that is to be secured for shipment. Note that, after the roof panels are raised and secured in their final position, screws 38 are removed from anchor plates 31, and then the roof roller coupling and guide mechanisms (22, 31, 32, 34) are returned to the module plant for reuse.

Further, by making appropriate adjustments to the dimensions of the roof roller components, it is possible to use rafters or guide rails having various depths.

Further, as shown in FIG. 1, the roof panels 2*a*, 2*b* are mounted in a horizontal or flat position on top of the prefabricated housing module 1 in the plant, and the module is ready for shipment to the building site. As shown in FIG.

3, with each of the roof panels in the flat position for shipment, the vertical position of the roller assembly 22 is fixed by pinning the vertical adjustment tube 34 to the anchor tube 32. Since the roof roller assembly 22 is pinned to the anchor tube 34 while being transported, the roof panel is effectively prevented from sliding sideways or upwardly. Note, roof shingles, flashings, soffits, roof vents, and rake trim can be installed on the roof panels at the plant, while the roof panels are secured in the flat position on top of the gable panels 6, which are lying flat on the attic floor panel 8 of the housing module 1.

In FIGS. 2 and 4 the housing module is shown after it has been delivered to the building site, and after a crane has lifted the ridge of the roof panels 2*a*, 2*b*. Note, at this point, the module is still positioned on the transporter 10. The roof panels 2*a*, 2*b* are positioned at the selected design pitch, and are ready to be fastened by brackets (not shown) to the upper end of the housing module 1.

In order to raise the roof, the security pin is removed, and the vertical adjustment tube 34 slides down through the anchor tube 32, thereby guiding the roof panels 2*a*, 2*b* to bear on the top of the housing module 1. The roller assemblies 22 as described above, allow the overhanging roof panels 2*a*, 2*b* to slide in and up on the rolls 26 so as to form the ridge (apex) of the roof as shown in FIG. 2. Each of the roller assemblies 22 is permitted to pivot about the top of the vertical adjustment tube 34. As the roof panels 2*a*, 2*b* are raised, the gable panels 6 slide out and assume their vertical positions above the attic floor panel 8.

A welded steel bar (not shown) can be provided to control the vertical position of the roof panels relative to the top of the module.

The roof panels can vary in planametric view, enabling virtually unlimited roof designs in their erected positions. The roof roller coupling and guide mechanism of the present invention allows the roof panels to cantilever relative to the front and rear ends of the transporter, and thereby provide the additional length necessary to accommodate the hypotenuse dimension of the sloping roof panels.

The roof roller guide mechanism of the present invention is capable of holding the roof and gable panels safely in place during shipping, controlling and guiding the alignment and movement of the multiple stacked panels while they are being elevated into their final position by a crane.

The method of transporting the housing module will now be described.

Initially, a pre-fabricated base structure having a floor panel and a plurality of vertical wall panels is constructed in a plant. The attic floor panel 8, assigned to become a part of the housing module, is completely fabricated and retained in a flat position at floor level in the plant. This facilitates placement of the gable panels 6 in their flat position on the attic floor panel 8, prior to mounting the roof panels 2*a*, 2*b* in a horizontal or flat position on top of the gable panels 6. The roof panels are securely mounted on the attic floor panel with a plurality of the roof roller guide mechanisms 20 anchored at the transverse dimension of the housing module at each end of the attic floor panel 8. The roof roller guide mechanisms 20 are capable of allowing the roof panels to slide during the field erection process with respect to and parallel to the longitudinal axis of the attic floor panel 8. This sub-assembly, which is composed of the attic floor panel 8, the gable panels 6 and the flat roof panels 2*a*, 2*b*, can now be hoisted, as a single component of the fabrication process, by overhead plant cranes and mounted on top of the module base structure, which was previously described. With the subassembly secured to the module base structure, the completed module is placed on a transporter and is ready to be transported to a building site (see FIG. 1).

Upon reaching the building site, the roof panels 2*a*, 2*b* are raised to a final predetermined sloped position (see FIG. 2). Crane lifting eyes can be built into the hinged connection between the edges of the roof panels in order to facilitate lifting of the roof panels by a crane.

After the roof panels 2*a*, 2*b* are raised, the gable panels 6 are secured to the attic floor panel 8 of the base structure. Then the structure is placed in a desired position at the building site.

In the exemplary embodiment described above, the roof roller guide mechanism 20 has a spring-loaded triple roller head. However, the most critical features of the guide mechanism are that it allows sliding and pivotal movement of the roof panels relative to the base structure. It is contemplated that various other structures without, for example, rollers, can be employed to secure the roof panels to the base structure and permit the necessary relative movement.

The roof coupling and guide mechanism permits roofs to span the longitudinal dimension of the module, which means that multiple modules of varying longitudinal dimensions can be positioned parallel to each other and connected by their marriage walls. The assembly of these modules perpendicular to front lot line can be staggered, extending toward the rear of the lot, and creating a staggered roof line of the structure, thereby using the lot to greater advantage and providing a much more interesting front elevation with spatial modulation.

Further, the roof coupling and guide mechanism permits the shipping of roof panels in a flat position on the prefabricated modules so as to comply with all shipping regulations and to create steep roof slopes similar to conventional construction. The flat panel roof construction when erected creates an attic space which can be expanded into future living space or storage area as did early construction prior to the current wood truss period. The roofs of conventional homes with wood trusses create a volume of space, which is not habitable due to the forest of web members composing the trusses.

The modules that can be created with the novel roof roller guide mechanism provides advantages such as:

1. An open attic without truss members which destroy accessibility and use of the space.
2. Accessibility to each attic space is via a straight run stairway parallel to the front to rear marriage walls, which is possible due to the increased depth of the modules.
3. Front to rear module and roof orientation allows for future expansion on each side of the house.
4. Standardization of the module widths of 12' & 14' and orientation front to rear allows mixing module widths in the same structure with identical roof pitch to better accommodate room dimensional requirements.
5. Front to rear module orientation allows the insertion of an engine module which provides all of the mechanical services of the structure.
6. Engine modules can be a standardized design, that is interchangeable in multiple house designs thereby allowing mass production of the most costly elements of a home.
7. Front to rear module orientation allows the standardization of modules by room type thereby permitting customers to pick and choose varying module types to design their own home. This provides the economy of standard manufactured space components, but still retains unlimited planning options for the homeowner to create the final house design with a variety of aesthetic styles and prepackaged options.

The foregoing description of a preferred embodiment of the present invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application so as to enable one skilled in the art to utilize the invention in various embodiments and with various modifications as are suited to the particular use contemplated. It is intended that the scope of the invention be defined by the claims appended hereto, and their equivalents.

I claim:

1. A prefabricated housing module comprising:

a base structure having a plurality of vertical wall panels;

a roof comprising at least two major roof panels each having a plurality of C-shaped members, wherein opposing edges of said roof panels, arranged perpendicular to a longitudinal dimension of the base structure, are hingedly connected together; and a plurality of roof coupling mechanisms securing said roof panels to said base structure such that said roof panels are movable between a horizontal transport position and a final raised position, each of said roof coupling mechanisms comprising a coupling assembly detachably engaged with one of said C-shaped members so as to control movement thereof relative to the roof coupling mechanism, and an anchor assembly pivotally coupled to said coupling assembly so as to permit pivotal and vertical movement of said coupling assembly.

2. The prefabricated housing module as claimed in claim 1, wherein said coupling assembly comprises:

a plurality of rollers; and a locking device for locking said rollers in a configuration adapted to engage surfaces of the C-shaped member, wherein said locking device can be released to permit said rollers to be removed from the C-shaped member.

3. The prefabricated housing module as claimed in claim 1, wherein said coupling assembly comprises:

a first roller connected to a first end of a first connecting plate;

a second roller connected to a second end of said first connecting plate and a first end of a second connecting plate; and a third roller connected to a second end of said second plate, wherein said rollers are moveable between a triangular engagement configuration and a release position.

4. The prefabricated housing module as claimed in claim 3, said coupling assembly further comprising a locking device for releasably locking said rollers in the triangular engagement configuration.

5. The prefabricated housing module as claimed in claim 4, further comprising a plurality of gable panels hinged to edges of said roof panels, wherein said base structure includes an attic floor panel interconnecting upper edges of vertical walls.

6. The prefabricated housing module as claimed in 1, wherein each of said anchor assemblies comprises an anchor plate secured to an attic floor panel of said base structure, an anchor tube connected to said anchor plate, and a vertical adjustment tube slidably received in said anchor tube.

7. The prefabricated housing module as claimed in 6, wherein an upper end of said vertical adjustment tube is connected to said coupling assembly so that the coupling assembly can pivot relative to said vertical adjustment tube.

8. The roof coupling and guiding apparatus as claimed in 6, wherein said anchor tube includes at least one through hole, and said vertical adjustment tube includes a plurality of through holes.

9. The roof coupling and guiding apparatus as claimed in 1, wherein each of said C-shaped members comprises a rafter or a guide rail.

10. A roof coupling and guiding apparatus comprising:

a coupling assembly adapted to be detachably coupled in an interior space defined by a web, two flanges, and two inwardly directed lips of a C-shaped member of a roof panel so as to guide pivotal and longitudinal movement of the C-shaped member relative to the coupling assembly; and an anchor assembly coupled to said coupling assembly so as to permit pivotal movement of said coupling assembly, said anchor assembly being adapted to permit vertical adjustment of a position of said coupling assembly, wherein said coupling assembly comprises:

a plurality of rollers; and a locking device for locking said rollers in an engagement configuration adapted to engage surfaces of the C-shaped member, wherein said locking device can be released to permit said rollers to be moved from the engagement configuration so that said rollers can be removed from the C-shaped member.

11. A roof coupling and guiding apparatus comprising:

a coupling assembly adapted to be detachably coupled in an interior space defined by a web, two flanges, and two inwardly directed lips of a C-shaped member of a roof panel so as to guide pivotal and longitudinal movement of the C-shaped member relative to the coupling assembly; and an anchor assembly coupled to said coupling assembly so as to permit pivotal movement of said coupling assembly, said anchor assembly being adapted to permit vertical adjustment of a position of said coupling assembly, wherein said coupling assembly comprises:

a first roller connected to a first end of a first connecting plate;

a second roller connected to a second end of said first connecting plate and a first end of a second connecting plate; and a third roller connected to a second end of said second plate, wherein said rollers are moveable between a triangular engagement position and a release position.

12. The roof coupling and guiding apparatus as claimed in claim 11, said coupling assembly further comprising a locking device for releasably locking said rollers in the triangular engagement position.

13. The roof coupling and guiding apparatus as claimed in claim 12, wherein said locking device is spring tensioned.

* * * * *